United States Patent [19]

Maul

[11] 4,248,184

[45] Feb. 3, 1981

[54] TWO-CYCLE DIESEL INTERNAL COMBUSTION ENGINE

[75] Inventor: Thomas A. Maul, Cuyahoga Falls, Ohio

[73] Assignee: Maul Enterprises, Cuyahoga Falls, Ohio

[21] Appl. No.: 44,981

[22] Filed: Jun. 4, 1979

[51] Int. Cl.[3] ..... F02B 75/02; F02B 39/09

[52] U.S. Cl. ..... 123/65 R; 123/65 V; 123/65 PD; 123/47 R; 123/73 AA

[58] Field of Search ..... 123/73 FA, 73 AA, 65 V, 123/65 PD, 65 P, 47 R, 65 R

[56] References Cited

U.S. PATENT DOCUMENTS

| | | | |
|---|---|---|---|
| Re. 12,249 | 7/1904 | Ostergren | 123/73 AA |
| 856,647 | 6/1907 | Maud | 123/73 AA |
| 1,423,578 | 7/1922 | Neighbour et al. | 123/73 AA |
| 1,664,782 | 3/1928 | Ragdeburger | 123/73 AA |
| 2,334,972 | 11/1943 | Wallgren | 123/73 AA |

*Primary Examiner*—Wendell E. Burns

*Attorney, Agent, or Firm*—Oldham, Oldham, Hudak & Weber Co.

[57] ABSTRACT

An improved two-cycle Diesel internal combustion engine is provided, whereby the intake and exhaust port passages are modified to provide greater circulation of the combustible fluids and air during the intake and exhaust cycles of the Diesel engine, respectively. The intake passages are so located in each piston and each cylinder to provide communication thereinbetween during the intake cycle with the piston at the bottom of its stroke which effects the exhaust cycle simultaneously substantially similar to a normal two-cycle operation. The intake passages in each cylinder communicate with intake passages in each piston which are connected to an intake flume port located epicentrically in the upper portions of each piston. The movement of the combustible fluids and the evacuation air is directed from the intake flume port and deflected off a conical protrusion in the upper surface of the cylinder, in order to promote circulation of the combustible fluids and the evacuation air, respectively.

5 Claims, 4 Drawing Figures

TWO-CYCLE DIESEL INTERNAL COMBUSTION ENGINE

BACKGROUND OF THE INVENTION

This invention relates to improvements to the two-cycle Diesel internal combustion engine, whereby the intake and exhaust ports on the piston and the cylinder are modified to promote greater circulation of intake gases and exhaust gases during the intake cycle and the exhaust cycle.

Heretofore, numerous inventions have been made improving the performance of internal combustion engines having two-cycles or two strokes as their mode of operation. For example, U.S. Pat. No. 3,695,239 and U.S. Pat. No. 4,026,254 teach the modification of the piston to accomplish a variety of compression engineering objectives. U.S. Pat. No. 2,090,149 and U.S. Pat. No. 3,858,562 teach other modifications of the piston head which have attempted to improve the performance of two-cycle internal combustion engines. An improved direction for the exhaust gases was disclosed in U.S. Pat. No. 2,778,348 in alignment with passages rendered available by the movement of the piston on its downward stroke. U.S. Pat. No. 1,550,703 discloses modifications to the side wall and head of the piston which generate helical fluid motion within the bore of the cylinder. Such spiral movement of the gases within the bore directs the exhaust through the central recess located in the head of the piston. U.S. Pat. No. 3,870,025 teaches the employment of recesses in the periphery of the piston head in combination with a spike located in the upper surface of the piston, both structures being designed to promote exhaust of the gases combusted.

Each of the structures disclosed sought improved performance of the internal combustion through modification of the basic compression mechanism. However, there were significant disadvantages to the structures described above, in that the structure used to improve certain intake functions detrimentally affected the exhaust functions, and vice versa. Consequently, an internal combustion engine having modifications to the piston and cylinder which effect improvements to both the intake and exhaust cycles utilizing the same structure is desired. Specifically, a structure is desired which improvements to both cycles yield a syngergistic improvement to the overall performance of the entire engine.

SUMMARY OF THE INVENTION

Consequently, it is an object of the invention to provide an improvement to the two-cycle Diesel internal combustion engine whereby one structure improves the performance of both the intake and exhaust cycles.

Another object of the invention is to provide an improvement to the two-cycle Diesel internal combustion engine, whereby the modifications to the piston correspond to the modifications of the cylinder wall.

Yet another object of the invention is to provide an improved internal combustion engine, as above, wherein the modifications in the cylinder communicate with the modifications in the piston during both the intake and the exhaust cycle.

Yet another object of the invention is to provide an improved internal combustion engine, as above, wherein the intake cycle is improved by greater circulation of the intake gases within the bore of the cylinder.

Still another object of the invention is to provide an improved internal combustion engine, as above, wherein the exhaust cycle is improved by injecting a compressed gas into the bore to evacuate the exhaust gases during the exhaust cycle.

It is another object of the invention to provide an improved internal combustion engine, as above, wherein modifications to the piston and the cylinder effect greater circulation of the injected gas to facilitate rapid evacuation of the exhaust gases during the exhaust cycle.

These and other objects, which will become apparent as the detailed description of the preferred embodiment proceeds, are achieved by an improvement to an internal combustion engine having at least one cylinder and piston, including intake passages, and exhaust passages for the transformation of combustible fluids and input gas into released energy and evacuated exhaust fluids, wherein the improvement comprises: (a) an exterior cylindrical surface of said piston having a plurality of intake ports therein; (b) an exterior compression surface of said piston having an intake flume port and means for projecting new input gas, each said intake port communicating with said intake flume port and said projecting means directing the input in a direction orthogonal to said exterior compression surface; (c) an interior compression surface of said cylinder for deflecting the new input gas convexly within the bore of said cylinder; and (d) an interior cylindrical surface of said cylinder having a plurality of intake outlets and a plurality of exhaust ports, said exhaust ports closer to said interior compression surface than said intake outlets and said intake ports of said exterior cylindrical surface of said piston, said intake outlets and said intake ports communicating during the intake-exhaust cycle whereby the input gas is introduced into the cylinder to evacuate the exhaust fluids.

DESCRIPTION OF THE DRAWINGS

For a complete understanding of the scope of the invention, reference is had to the following drawings, wherein.

DETAILED DESCRIPTION OF THE PREFERRED EMBODIMENTS

Figure 1:
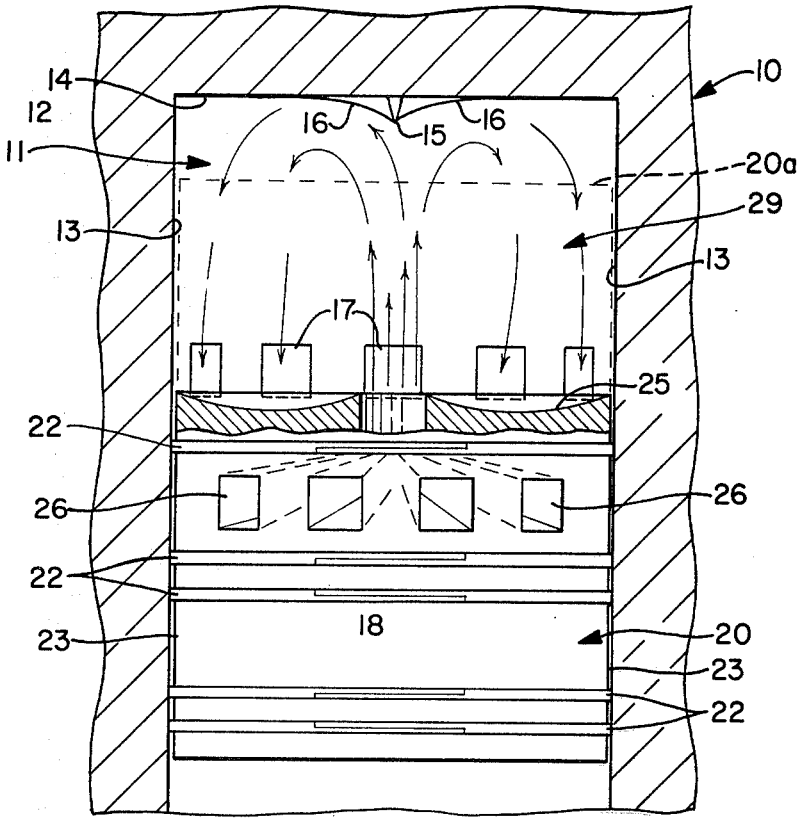
FIG. 1 is a modified side plan view of the improved piston and the improved cylinder, the modification being the cross-sectional treatment of the internal combustion engine block.

Reference is had to FIG. 1 to facilitate a complete understanding of the scope of the invention. The internal combustion engine 10 has been cut away to show the cylinder, generally referred to as 12, and the piston, generally referred to as 20. The cylinder has interior cylindrical surfaces 13, interior compression surface 14, and fuel injection port 15.

The piston has piston rings 22, exterior cylindrical surfaces 23, and exterior compression surface 24. The modifications to each of these surfaces 13, 14, 23 and 24 result in the improved performance of the internal combustion engine 10, satisfying the objectives of the invention listed above.

Figure 2:
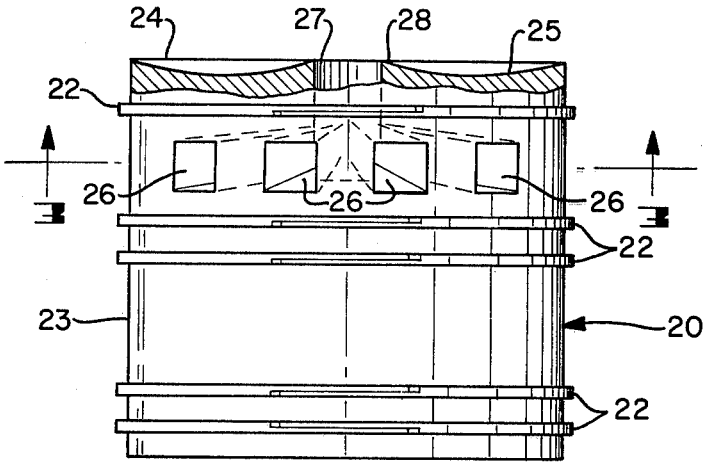
FIG. 2 is a side plan view of the modified piston.
Figure 3:
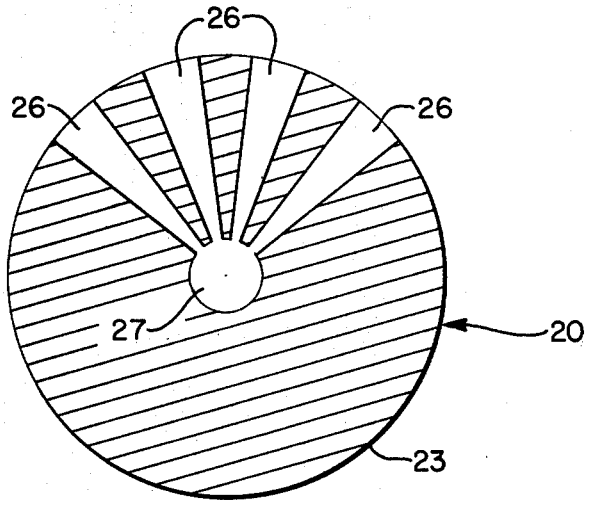
FIG. 3 is a cross-sectional view of the modified piston taken on lines 3—3 of FIG. 1.

The modification to the exterior cylindrical surfaces 23 and the exterior compression surface 24 of piston 20 is understood by examining FIGS. 2 and 3. Exterior cylindrical surfaces 23 have a plurality of piston intake ports 26 located in the upper portion of the piston 20. This plurality may be of sufficient number to provide adequate intake of the evacuation air which also provides the fresh air for the next combustion, as will be more fully described hereinbelow. Each of the intake ports 26 has a passage from the exterior surface of the exterior cylindrical surface 23 to a piston intake flume port 27 residing in the epicenter of the upper portions of the piston 20. The combination of piston intake ports 26 in communication with piston intake flume port 27 provides a complete passageway from the exterior cylindrical surface 23 to the exterior compression surface 24. Therefore, the transfer of the evacuation air may transfer from the intake manifold through the ports 26 and 27 and into the bore of the cylinder, generally designated as 11 in FIG. 1.

Located on exterior compression surface 24 is a series of modifications to promote the direction of the combustible fluids and evacuation air upon transfer through the piston intake flume port 27. The exterior compression surface 24 is modified to include a flume protrusion 25 serving as means for the evacuation air in a direction orthogonal to exterior compression surface 24 has been modified to provide compression recess 25 about the flume protrusion 28.

Referring now to FIG. 3, an understanding of the communication of piston intake ports 26 and piston intake flume port 27 is understood. As seen from this view, the flume port 27 in the epicenter of the piston 20 exists along the axial line of the piston 20. The piston intake ports 26 have a trapezoidal configuration as each port 26 is defined from the exterior cylindrical surface 23 to flume port 27.

Figure 4:
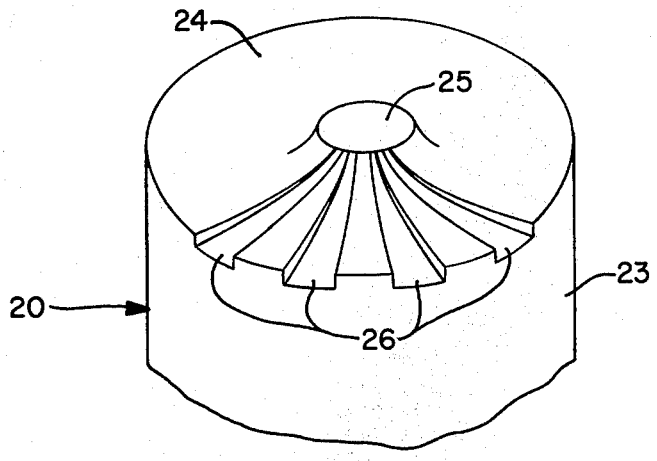
FIG. 4 is a perspective view of another embodiment of the modified piston.

Another embodiment of the modification piston 20 may be understood by examining FIG. 4, a perspective view thereof. Both the exterior cylindrical surfaces 23 and the exterior compression surface 24 of piston 20 are altered from the previous embodiment in that the plurality of piston intake ports 26 reside in the upper portion of piston 20 adjacent to the exterior compression surface 24. That is to say, the ports 26 are formed from channels in surface 24 eliminating the inake flume port 27. The evacuation air and intake air are thereby deflected through ports 26 against the outer perimeter of flume protrusion 25 and into the bore 11 of cylinder 12. Alternatively, flume and protrusion 25 can extend higher from piston 20 and ports 26 can be eliminated, without departing from the scope of the invention, as long as evacuation air and fresh air are deflected into the bore 11, as described above, with extended flume protrusions 25.

The materials for casting the modified piston 20 and the modified cylinder within the internal combustion engine 10 may be made of any materials commonly known to those skilled in the art for producing internal combustion engine components. Alloys of iron and steel, as well as alloys of aluminum and magnesium, have been utilized in the past with great success for the overall performance of the internal combustion engine 10.

Referring again to FIG. 1, an understanding of the modifications to the cylinder 12 may be seen and understood. The interior cylindrical surface 13 has been modified to provide a bilevel series of ports for the intake and exhaust cycles of the engine 10. Cylinder intake outlets 18, connected to intake manifold (not shown), reside in the wall of the cylinder 12 which has been cut away in FIG. 1 to show the piston 20 and its piston intake ports 26. However, the position of piston intake ports 26 on exterior cylindrical surface 23 is in direct communication with cylinder intake outlets 18 located on the interior cylindrical surface 13 of the cylinder 12. The position of the piston 20 within the cylinder 12 at the moment in the cycle shown in FIG. 1 is demonstrated by virtue of the fact that evacuation air injected through cylinder intake outlets 18 is transferred through intake flume port 27 by communication with piston intake ports 26.

On the interior cylindrical surface 13, but at a position closer to interior compression surface 14 than either cylinder intake outlets 18 or piston intake ports 26 reside exhaust ports 17. The position of exhaust ports 17 is crucial to the performance of the two-cycle combustion engine 10. The ports 17 must be closer to the interior compression surface 14 than either ports 26 or outlets 18 in order for the exhaust cycle to occur while the piston 20 progresses through the bottom portion of the cycle.

An optional modification to the interior compression surface 14 is also illustrated by reference to FIG. 1. In an area surrounding the fuel injection port 15, the interior compression surface 14 has been modified to create a conical protrusion 16 as means for deflecting the direction of the injected evacuation gas during the intake-exhaust cycle. As the evacuation gas is injected into bore 11 from the intake flume port 27 in a direction orthogonal to the surface of exterior compression surface 24, the presence of conical protrusion 16 deflects the path of the fluid from the epicenter of the bore convexly throughout the entire bore 11 of the cylinder 12. As the result of this motion, the intake air is efficiently mixed and dispersed within the bore 11 of cylinder 12 during the intake cycle, while at the same time effecting a nearly total evacuation of the gases of combustion as it forces evacuation of the exhaust fluids from the bore 11 of cylinder 12.

For an understanding of the entire cycle of the internal combustion engine 10 with modified piston 20 and modified cylinder 12, reference should be made to FIG. 1. With the piston 20 at the bottom of its stroke as indicated at FIG. 1, the air blast has been applied through the intake ports 26 effecting an exhaustion of the gases of combustion from the cylinder 11 out the exhaust port 17 by having a complete wiping of all the internal surfaces 13 of the cylinder by the air flow path indicated generally by the number 29, and of course the path having the direction indicated by the arrows on the air flow path lines. The air blast is preferably timed so that only sufficient air is injected to affect the proper exhaustion of the gases of combustion and to fill the cylinder 11 with a fresh supply of air. The piston 20 then begins to move upwardly closing off ports 26 at a point in time slightly before ports 17 are closed off. Of course, as the piston moves on upwardly, the fresh supply of air begins to compress and when the piston reaches a point indicated by the chain dotted line as numeral 20*a*, the air will have been greatly compressed and have risen in temperature to perhaps 1,000°F., at which point in time, it is slightly before its uppermost point. At this point in time, and in a conventional manner, fuel will be injected from port 15 that will be instantaneously ignited by the hot air so that the combustion takes place at the appropriately timed point to then drive the piston back down in the cylinder in the conventional manner. As the piston 20 moves on down, being driven by the combustion within cylinder 11, the exhaust port 17 will be open slightly before the intake ports 26 begin to align and open with inlets 18. This ensures that no back pressure from the combustion will be directed down flume port 27 and out the inlet ports 26.

Hence, it should be understood that the improvements in the invention are achieved by providing the improved flow path of the new intake air to wipe all sides of the cylinder to effect a nearly complete exhaustion of the gases of combustion, this improved flow path being achieved by the relationship of the intake ports through the piston and the inlet flume 28. The deflecting conical protrusion may be helpful in achieving the flow path 29, but it is believed that in some instances where this might interfere with the compression ratio of the piston cylinder arrangement, that it might be eliminated since the upwardly deflected flow path 29 will tend to occur naturally, even without the conical deflector 16. In that instance, the fuel injection port 15 would move up to immediately adjacent the top of the cylinder 14, all of which is of substantially conventional design.

While the invention has been illustrated and described as being related to a Diesel two-cycle fuel injected engine, it is to be understood that the same principles may apply to a globe plug-type engine or even a fuel injected gasoline engine, since the piston and cylinder modifications could be utilized on these types of internal combustion structures as well.

With proper alignment of the intake and exhaust ports, with exhaust ports opening slightly ahead of the intake ports on the downstroke of the piston, and with the intake air now able to achieve a much improved flow path within the cylinder to effect exhaust and presentation of fresh input air, a much more highly efficient operation of the combustion cycle should take place which would result in fuel economy and improved performance.

Only a single piston-cylinder relationship is shown in FIG. 1, it is to be understood that the invention is applicable to multiple pistons and cylinders in the way well understood by those skilled in the art, and that these will preferably operate with crank shafts, piston rods, and that type of interconnected arrangement to achieve drive and effective conversion of power from the internal combustion within the piston chamber.

While a modified piston and cylinder have been described as the best mode and preferred embodiment of the invention, the invention is not to be limited thereto or thereby, but the scope of the invention shall be defined in the appended claims.

What is claimed is:

1. An improvement to an internal combustion engine having at least one cylinder and piston, including intake passages, and exhaust passages for the transformation of combustible fluids and input gas into released energy and evacuated exhaust fluids, wherein the improvement comprises:

(a) an exterior cylindrical surface of said piston having a plurality of intake ports therein;

(b) an exterior compression surface of said piston having means for projecting new input gas in a direction orthogonal to said exterior compression surface, and further having a recessed area to cooperate with said projecting means to enhance compression within the cylinder, said projecting means comprising a flume port for controlled projecting of the new input gas;

(c) an interior compression surface of said cylinder for deflecting the new input gas convexly within the bore of said cylinder, said interior compression surface having a combustible fluid injection port therein and said exterior compression surface extending on upward stroke to a point where said flume port is physically apart from association with said interior compression surface; and (d) an interior cylindrical surface of said cylinder having a plurality of intake outlets and a plurality of exhaust ports, said exhaust ports closer to said interior compression surface than said intake outlets and said intake ports of said exterior cylindrical surfaces of said piston, said intake outlets and said intake ports communicating during the intake-exhaust cycle whereby the input gas is rapidly introduced and forcefully injected as a flume into the cylinder to flush and evacuate the exhaust fluids.

2. An improved internal combustion engine according to claim 1 wherein the interior compression surface of each cylinder includes means in conjunction with the surface for deflecting the new input gas convexly within the bore of said cylinder.

3. An improvement to an internal combustion engine according to claim 1 wherein the exhaust ports are positioned so as to be uncovered by the piston before the intake ports as the piston moves in its downward stroke during the combustion cycle.

4. An improvement to an internal combustion engine according to claim 3 wherein each said intake port has a tangentially converging slot and said exterior compression surface has an intake flume port concentrically adjacent to said input gas projecting means and vertically communicating with said tangentially converging slots, whereby the input air is directed into the bore of the cylinder orthogonally to said exterior compression surface.

5. An improvement to an internal combustion engine according to claim 3 wherein each said intake port is channeled substantially adjacent to said exterior compression surface whereby the input air is directed into the bore of the cylinder orthogonally to said exterior compression surface.

* * * * *

UNITED STATES PATENT OFFICE

CERTIFICATE OF CORRECTION

Patent No. 4,248,184 Dated Feb. 3, 1981

Inventor(s) Thomas J. Maul

It is certified that error appears in the above-identified patent and that said Letters Patent are hereby corrected as shown below:

Title Page of Patent Application should read as follows:

[75] Inventor: Thomas J. Maul, Cuyahoga Falls, Ohio

Signed and Sealed this

*Twenty-eighth* Day of *April 1981*

[SEAL]

*Attest:*

RENE D. TEGTMEYER

*Attesting Officer* *Acting Commissioner of Patents and Trademarks*